US009232835B2

(12) United States Patent
Kearl

(10) Patent No.: US 9,232,835 B2
(45) Date of Patent: Jan. 12, 2016

(54) ZIPPER PULL ATTACHMENT

(71) Applicant: Rachel Kearl, San Clemente, CA (US)

(72) Inventor: Rachel Kearl, San Clemente, CA (US)

(73) Assignee: KEVEL INCORPORATED, San Clemente, CA (US)

( * ) Notice: Subject to any disclaimer, the term of this patent is extended or adjusted under 35 U.S.C. 154(b) by 154 days.

(21) Appl. No.: 14/046,766

(22) Filed: Oct. 4, 2013

(65) Prior Publication Data

US 2014/0223698 A1 Aug. 14, 2014

Related U.S. Application Data

(63) Continuation of application No. 13/763,189, filed on Feb. 8, 2013, now abandoned, and a continuation-in-part of application No. 29/445,265, filed on Feb. 8, 2013, now Pat. No. Des. 706,166.

(51) Int. Cl.
*A44B 1/04* (2006.01)
*A44B 19/30* (2006.01)

(52) U.S. Cl.
CPC ..... *A44B 19/301* (2013.01); *Y10T 24/25* (2015.01)

(58) Field of Classification Search
CPC .... A44B 19/301; A44B 19/262; Y10T 24/25; Y10T 24/2511; Y10T 24/2586; A41F 1/02
USPC ..... 24/381
See application file for complete search history.

(56) References Cited

U.S. PATENT DOCUMENTS

| | | | | |
|---|---|---|---|---|
| 2,675,559 | A * | 4/1954 | Miller | 2/234 |
| 4,580,298 | A * | 4/1986 | Tuisl | 2/237 |
| 8,533,918 | B1 * | 9/2013 | Ketter et al. | 24/387 |
| 2005/0257351 | A1 * | 11/2005 | Pitts et al. | 24/436 |
| 2007/0289110 | A1 * | 12/2007 | Bekeschus | 24/436 |
| 2012/0047693 | A1 * | 3/2012 | Buchanan | 24/369 |
| 2012/0174347 | A1 * | 7/2012 | Higgins | 24/390 |
| 2013/0255041 | A1 * | 10/2013 | Weinstein | 24/387 |

* cited by examiner

*Primary Examiner* — Robert J Sandy
*Assistant Examiner* — Matthew Sullivan
(74) *Attorney, Agent, or Firm* — Jeffery M. Lillywhite, PC

(57) ABSTRACT

A zipper pull attachment includes a flexible ring having a hole sized to fit snugly around a button on jeans. A base is attached to the ring and configured to be used as a grip. A support cord is attached to the base opposite the ring. The support cord forms a loop and is sized to fit through and attach to an eye of a zipper pull tab. In another embodiment, the zipper pull attachment includes a fastener expansion cord that is attached to the base.

10 Claims, 6 Drawing Sheets

ZIPPER PULL ATTACHMENT

CROSS-REFERENCE TO RELATED APPLICATIONS

This application claims the benefit of and is a Continuation of U.S. application Ser. No. 13/763,189 filed Feb. 8, 2013 and a Continuation of U.S. Application No. 29/445,265 filed Feb. 8, 2013. The entire disclosure of the prior applications are hereby incorporated by reference in their entirety.

BACKGROUND OF THE INVENTION

1. The Field of the Invention

The present invention relates to a zipper restraining device which holds a zipper open to a preselected elevation and alternately provides an option for a flexible fastener expansion in conjunction with that zipper support.

2. The Relevant Technology

The past inventions may be categorized into different categories. The first is a device that provides a lock for a zipper that won't allow the zipper to be opened by accident if it was not locked properly, or if it for some reason became unlocked because it was lifted up, releasing the lock. These devices gave the wearer total security that the zipper was at all times held in place and would never be an embarrassment to the wearer of the garment (pants or jeans or other garments) due to an open zipper.

Another category of devices may include a device that allows the wearer to have an expandable fly which allows for an increase in girth or waist size of the wearer. This is especially useful for a woman who desires to wear her normal garment during her term of a pregnancy. This device would allow the woman to wear her designer jeans, for example, through the majority of her pregnancy. The other use for these devices would be for either gender to be able to continue wearing their garments through the various stages of weight gain or subsequent loss. One can imagine the amount of savings involved by allowing this flexibility.

Looking in detail at the devices categorized under the zipper locking type, one can find the following patents: U.S. Pat. No. 4,817,769, Hasp Lock, Zipper and Cover Assemble for Portfolio. This is a zipper support that is designed for a portfolio/briefcase. It is made of metal, incorporates two magnets to grasp the zipper and the closure device to hold the zipper closed. It also provides for a combination locking mechanism and a covering over the device to hide it from view.

U.S. Pat. No. 4,928,363, Zipper Securing Ring. This device is a sheet metal device that is in a teardrop shape. The top or wider part of the teardrop has a hole in it that allows the device to fit over the garment button, thereby holding it in place behind the garment button. The opposite end of the teardrop device has a hook that one may slip into the eye of the zipper pull tab 40. The device therefore, when in place will not allow the zipper to move in relation to the button on the waist of the garment.

U.S. Pat. No. 5,008,985 Zipper Securing Device. This is a device, similar to the above teardrop design, in that it is made up of a "C" shaped sheet metal piece that fits behind, and is supported by the garment waist button and attached to the "C" is a hook which, again attaches to the eye of the zipper pull tab 40. The main difference between patent '363 and '985 is that '985 is easier to slip under the garment button, due to the opening of the "C" as opposed to the entire circle that has to pass over the garment button.

Each of these devices, however, are lacking in various aspects. For example, the existing devices do not provide total secure capture of the zipper. The hook that feeds into the eye of the zipper pull tab 40 may become dislodged if there is any upward pressure on the zipper pull tab. The "C" button attachment may become dislodged with upward and sideways pressure. It is not a guaranteed fastening device, as was the case with the hook that fastens to the eye of the zipper.

The existing zipper securing devices do not offer any flexibility, or movement of the fastening device. If flexibility was provided and the hook was allowed to move slightly, stress may be relieved, allowing the zipper to have a longer life. With the zipper unlocked and only held in place by the zipper support, there could be a large amount of pressure against the zipper trying to force it to open. If flexibility were provided in the design, it would allow forces on the zipper to be reduced as more pressure is applied trying to open the zipper.

Looking in detail at the devices categorized under the fastener expansion type, one can find the following patents: U.S. Pat. No. 5,163,184, Expanded Waistband Structure for Garments. This device offers a triangular shaped insertion pie shaped piece of fabric. It is meant to provide a privacy panel in jeans when the jeans or garment has an open zipper. With the zipper open, the waist band of the pant or garment is expanded in the area that is most needed to provide for expansion. This expansion would occur for either a woman who needs a wider girth due to pregnancy, or someone who requires more girth due to expanded waist size. This insert is provided with button holes in the two tapered sides of the triangular expansion insert. The jeans or garment may then have buttons attached to each side of the zipper where these buttons correlate with the button holes in the triangular expansion insert.

The problem with this design is that the buttons will need to be moved each time there is a need to allow for further growth. The panel is inflexible fabric and therefore provides no room for growth of the wearer. It does provide a solid panel that will hide the undergarments of the wearer.

U.S. Pat. No. 6,085,356, Waistxpander. This is a flexible strap device that on one end attaches to the button on the waist of the jeans or garment and the other end of the device attaches to the hole in the jeans or garment by means of a button attached to the flexible strap. The disadvantage with this is that the zipper is not controlled or captured and the zipper will eventually fall to the bottom of the zipper's travel, thereby exposing the undergarments and not providing adequate support along the length of the zipper. It is adjustable for size of the strap, but the zipper will always have the ability to fall to the bottom of its travel.

U.S. Patent Application No. 2004/0049834 A1, Sleeve for Clothing Coverage and Support. This device is fabricated from expandable fabric and is made in the shape of a cylinder that wraps around the waist. The wearer steps into or slides the expandable fabric over the head and then pulls the expandable fabric over their waist, with approximately half of the fabric above the waist and half below the waist. The upper half of the material above the waist is then tucked into the inside of the jeans or garment. Therefore half of the fabric is on the outside of the jeans and half is on the inside of the jeans. This expandable fabric is wide enough so that both the inner material and outer material covers the open zipper area of the jeans or garment. The two layers of the flexible and expandable material therefore attempt to secure the jeans by means of friction between the expandable fabric and the jeans themselves.

U.S. Patent Application No. 2007/0256216 A1, Women's Maternity and Non-Maternity Suspenders. This invention comprises a single suspender on each side of the wearer. Each suspender attaches with a clasp to both the underside of a bra and to the waist band of the jeans, thereby affording a vertical support for jeans for women.

U.S. Patent Application No. 2008/0172769 A1. Separate Cylindrical Detachable Waistband Device Used To Temporarily Convert the Use of Regular Clothes Into Maternity Use. This device is similar to U.S. Patent App. No. 2004/0049834 A1 in that there is the expandable fabric around the waist, but in this case it is only one layer and rests on top of the jeans. It has a more secure method of holding up the jeans in relation to the expandable fabric, in that there are supports added on the inside of the expandable fabric which attach to the belt of the jeans, thereby providing a positive attachment to the jeans, in lieu of friction as in the prior art mentioned above.

In sum it may be said that the expandable fastener expansion devises mentioned above endeavor to provide a mechanism to hold unzippered jeans up. Some of them cover the open zipper area with fabric, others do not. Some of the devices provide firm upward support, such as the one that attaches to the underside of a woman's bra and to a lesser degree, the support tied to a belt on the jeans from an expandable fabric. None of these devices attempt to hold up the zipper at the same time as supporting the jeans, or while covering the open zipper area. The jeans would tend to look baggy if the zipper were not zipped up as far as possible, especially during the early stages of pregnancy, or in the case of a person who has gained some weight and wants to get further use out of his, or her jeans or other garment.

One can see a need for a device that not only provides support at the waist, but also supports the zipper in whatever elevation can be obtained. By holding the zipper in the maximum position of tightness, one can visualize how this would allow the wearer of the pants, jeans, or other garment to be able to maintain a good look with a proper fit that maintains the most flattering effect. This will be achieved by assuring that there is a proper tightness of the pants, or jeans in relation to the shape, or changing shape of the wearer. There are many modern designs of jeans that, when purchased, are purposely tight fitting. Just the smallest amount of Thanksgiving dinner, etc, would preclude a person from wearing those now too tight designer jeans. Therefore there is a distinct need for a device that allows both modest, or, especially in the case of a pregnant woman, more robust adjustment of the jeans or garment. In all cases, it is very desirable to be able to maintain a firm fit as much as possible, but allow the flexibility for comfort to be achieved.

There is a great desire to maintain comfort with a look of tight fit or well-fitting garments. One can see this in the new designer jeans where the designer jean look is provided with a flexible material that tends to expand and contract as necessary, allowing comfort to the wearer. Another example is golf jeans that are provided with an expandable girth, or waist band.

BRIEF SUMMARY OF THE INVENTION

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

In one embodiment, a zipper pull attachment includes a flexible ring having a hole sized to fit snugly around a button on jeans. A base is attached to the ring and configured to be used as a grip. A support cord is attached to the base opposite the ring. The support cord forms a loop and is sized to fit through and attach to an eye of a zipper pull tab.

In another embodiment, a zipper attachment and expansion device includes a flexible ring having a hole sized to fit snugly around a button on jeans. A base is attached to the ring and configured to be used as a grip. A support cord is attached to the base opposite the ring. The support cord forms a loop and is sized to fit through and attach to an eye of a zipper pull tab. A fastener expansion cord is attached to the base. The fastener expansion cord is positioned at an offset of about 90 degrees from the support cord and forms a loop that is sized to fit from the base through a button hole and back to and around a button.

In another embodiment, a zipper pull attachment includes a body configured to be attached to a zipper and a button on jeans. The body is made of a flexible material. The zipper pull attachment includes means for attaching the body to the button without being dislodged. The zipper pull attachment also includes means for attaching the body to a zipper to allow the zipper to move to a closed position but restricts movement beyond a predetermined open position. The zipper is restricted from being substantially opened. The means for attaching the body to a zipper is made of a substantially non-stretchable material.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE VARIOUS EMBODIMENTS

Figure 1:
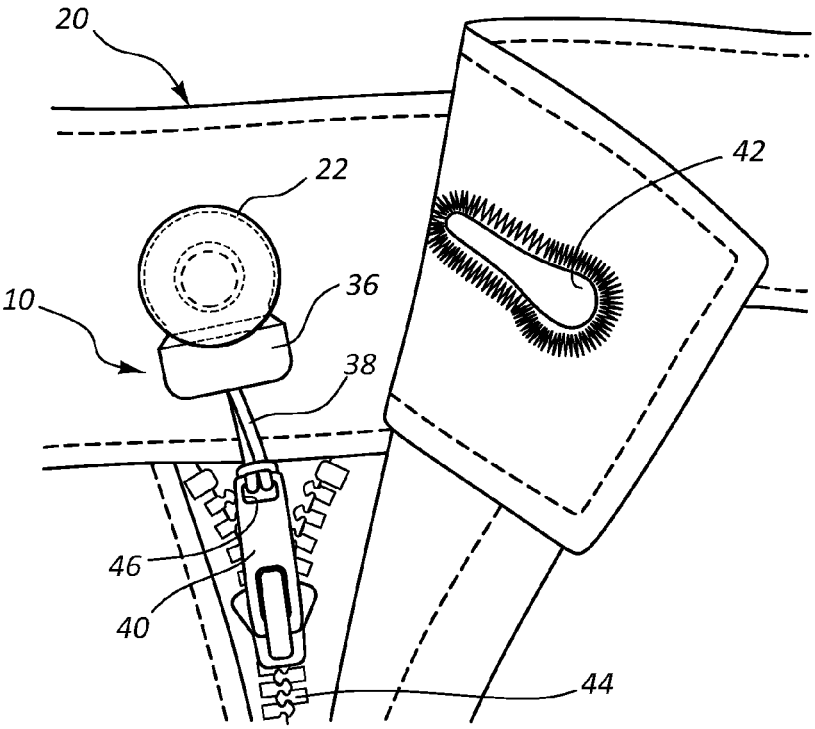
FIG. 1 depicts an assembly view of the zipper pull attachment as it is attached to pants, jeans, or other garment.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The various embodiments of the invention may provide separate features. One of the features embodied in the device is referred to as the zipper pull attachment, which supports the zipper in a preselected open position. Another embodiment may include this feature, as well as, a fastener expansion. The fastener expansion provides support for the expanded waist area of pants, jeans, slacks or other garments.

The zipper pull attachment will be discussed first. The attachment may be a standalone feature for occasions where it is desirable for a partially open zipper to be held in that position which has been preselected as a desirable opening.

There are several reasons why one would want to provide a supplementary lock on a zipper in a partially open position. One of those would be that it is required because the locking mechanism has ceased to function and without the locking mechanism, the zipper would continually open, causing embarrassment. Another reason is that one may want to have absolute assurance that the zipper will never open without the wearer releasing the zipper pull attachment. A further reason would be that the wearer has outgrown the pair of "designer jeans", jeans or other garment and the girth waist measurement needs to be expanded just slightly. This may be achieved by utilizing the zipper pull attachment. Another reason would be that the zipper may have broken one of the top teeth in the zipper. With the zipper pull attachment one would be able to support the zipper in a partially open position, just below the point of the break in the zipper teeth, thereby allowing additional wear time for the garment without replacing the zipper. Many times the zippers are backed by heavy fabric and are needed to be sewn to a heavy fabric of the pant or jeans and the assembly of the zipper and pant or jean material is difficult to sew, unless one has a commercial sewing machine. This device will therefore provide a longer life for the jeans, pants or other garment by allowing the use of the garment subsequent to various malfunctions occurring.

Existing zipper support devices do not provide a total secure capture of the zipper. On many of the existing devices, there is an open hook that feeds into the eye of the zipper to hold the zipper in a locked position. Depending on the activity of the wearer, the hook that feeds into the eye of the zipper pull tab may become dislodged if there is any upward pressure on the zipper pull tab, or if there is downward pressure on the garment button supporting the hook of the existing zipper supports. If the hook becomes dislodged, the zipper will drop, causing great embarrassment to the wearer.

In one existing device, for example, the support that is nested and supported by the waist fastening button on the garment is fabricated in the shape of the letter "C". Because the opening of the "C" allows easier entrance underneath the button on the garment, it also stands to reason that it offer easier detachment from behind the button. The "C" button attachment may become dislodged with upward and sideways pressure. It is not a guaranteed fastening device, as was the case with the hook that fastens to the eye of the zipper.

The existing zipper securing devices don't offer any flexibility, or movement in the zipper support device. Flexibility in the zipper support device would offer many advantages. One advantage is that if there is a relative movement between the garment waist button where the zipper support attaches and the zipper eye where the hook of the zipper support attaches, a flexible zipper support would be able to take up that movement and not become dislodged. The second reason is that with an amount of flexibility, one would be able to apply more stress to the zipper without causing additional stress to the zipper or the zipper support. It will simply cause the zipper to open slightly more relieving the added stress, allowing the zipper to have a longer life, and relaxing the tightness in circumferential waist pressure on the wearer. If flexibility were provided in the design, it would allow forces on the zipper to be reduced as more pressure is applied trying to open the zipper.

With the new design described herein, namely the zipper pull attachment, one is provided with both a secure latching mechanism and a degree of flexibility in the ring that attaches to the waist button on the jeans, pants, or other garment.

Figure 2:
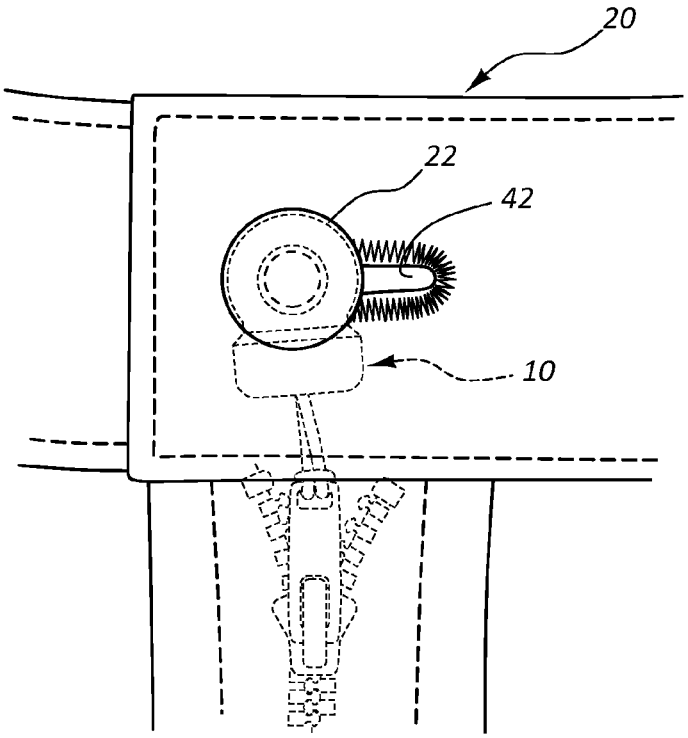
FIG. 2 shows an assembly view of the zipper pull attachment in a closed position.

FIGS. 1 and 2 depict the zipper pull attachment 10 as it looks in the attached position. In a pair of jeans, designer jeans, pants, or other garment 20, there is typically a waist fastening button 22. The waist fastening button 22 is utilized as a support for one end of the zipper pull attachment 10. As illustrated in FIGS. 3-9, one end of the zipper pull attachment 10 is made of a flexible neoprene or other rubberized material that is round or doughnut ring 32 in shape and provided with a center hole 34 and a base 36. As an integral part of the zipper pull attachment 10 a non-expanding support cord 38 is embedded into the base 36. The support cord 38 may be fabricated from a stretch resistant material with a strong, non-expanding interior support cord of nylon or other material and wrapped around the exterior of this cord is a tightly woven synthetic fabric to give it bulk for ease of handling that is required to attach it to the zipper pull tab 40 of the pants, jeans, or other garment.

10. The zipper pull attachment as claimed in claim 9, wherein the fastener expansion cord is made of a stretchy material. 11. The zipper pull attachment as claimed in claim 9, wherein the fastener expansion cord is disposed in the base and positioned at an offset about 90 degrees from the support cord.

The support cord 38 is arranged in the shape of a loop with ends of the cord 38 molded into the base 36 and looping around with the ends disposed on top of each other in a stacked fashion. The base 36 may have a thickness greater than the ring 32 to provide a grip for the user. The base 36 and the ring 32 may be formed of one continuous piece to define a body of the zipper pull attachment 10. The body may be molded, for instance, out of a flexible plastic material.

The support cord 38 is attached to the base 36 opposite the ring 32. The support cord 38 forms a loop and is sized to fit through and attach to an eye of a zipper pull tab. The base 36 is attached to the ring 32 and configured to be used as a grip. The ends of the loop are embedded into the base 36 of the zipper pull attachment 10 to make the loop. Prior to the zipper pull attachment 10 being attached to the button 22, the cord 38 is inserted into a zipper eye 42 of the zipper pull tab 40 and then the other end of the zipper pull attachment 10 or ring 32 is inserted through the support cord 38 loop, forming a tight half hitch knot around the zipper pull tab 40 at the upper end of the zipper eye 42.

Once the knot has been tied through the zipper eye 42, the ring 32 is fastened around the button 22. To do this the ring 32, which is quite flexible, is stretched over and around the waist fastening button 22 and then becomes lodged underneath the button 22. Because the ring 32 of the zipper pull attachment 10 is affixed under the button, the assembly is attached through this button 22 and through the knotted loop 38 forming a somewhat flexible connection in the zipper pull tab 40 to the button 22.

This button 22 when fastened through a button hole 42 is to some degree inflexible to the wearer but does provide a small amount of flexibility, depending on the size of the button hole 42. The zipper 44 is inflexible. Once the zipper 44 is fully zipped up and in the locked position, there is often very little, if any stretch in the waist band of the jeans 20, especially with the advent of the new "designer jeans".

Because the zipper pull attachment 10 is fastened in a knot, or loop, at the zipper eye 42 and also around the button 22, the zipper 44 is held in place and overcomes the disadvantages of other devices that do not offer the same security or holding ability. The zipper pull attachment 10 will not become dislodged with relative movement between the zipper pull tab 40 and the button 22 as is the case with other devices.

Not only does the zipper pull attachment 10 device offer secure holding capability, but another significant feature is that it also offers a small degree of flexibility which the other designs do not provide or make available. This flexibility is provided due to the small degree of flexibility provided by the ring 32 portion of the zipper pull attachment 10. The hole 34 is sized smaller than the button 22 to provide a secure fit, or to fit snugly around the button 22. The ring 32 is configured to expand over the outer circumference of the button 22 when attaching the device to the button 22. The ring 32 end of the zipper pull attachment 10 is made of a flexible neoprene or other rubberized material that is round or doughnut in shape and provided with the hole 34 that may be stretched around and fastened underneath the button 22.

FIG. 2 is a depiction of the zipper pull attachment 10 in an assembled state with the jeans 20 buttoned together over the zipper pull attachment 10. With the zipper pull attachment supported by the button 22 and the button 22 inserted into the button hole 42, which is supported by the waist band of the jeans 20 a total secure support system is provided the wearer. The support cord 38 is fastened over the eye 42 of the zipper pull tab 40 to hold the zipper and prevent it from slipping or becoming dislodged from the zipper pull attachment 10 or allow the zipper 44 to become unzipped. It can also be observed that the zipper pull tab 40, being held in place by the zipper pull attachment 10 protects the modesty of the wearer by not allowing the zipper 44 to extend below a point known by the wearer so that that area can be covered by a shirt, or blouse if necessary.

A further feature of the zipper pull attachment 10 is that it is available in different sizes so that the wearer may preselect the one that best suits the wearer. The device is provided with different lengths of support cords 38. Thusly, another size may be selected over time as the waistline grows.

A shirt or blouse is not required to cover the zipper area with the shorter support cord 38 options. The zipper pull attachment 10 device may be completely hidden under the waist band 20 of the pants, jeans, or other garment. At the same time the pants, jeans, or other garment maintains the intended shape, enhancing the look of the garment on the wearer.

Figure 3:
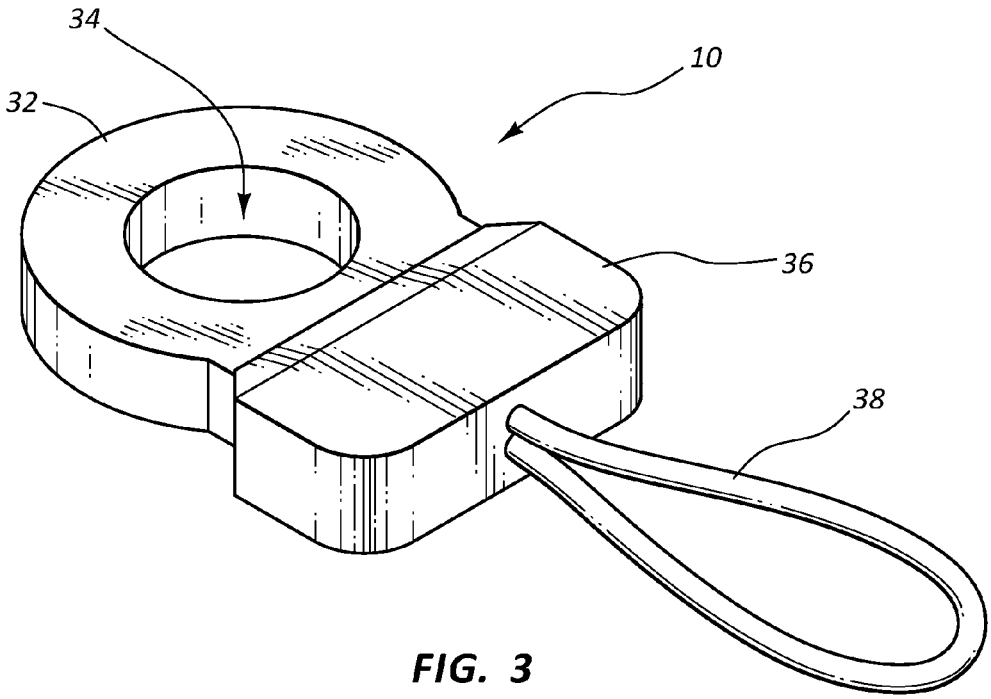
FIG. 3 shows an isometric first view of the zipper pull attachment.
Figure 4:
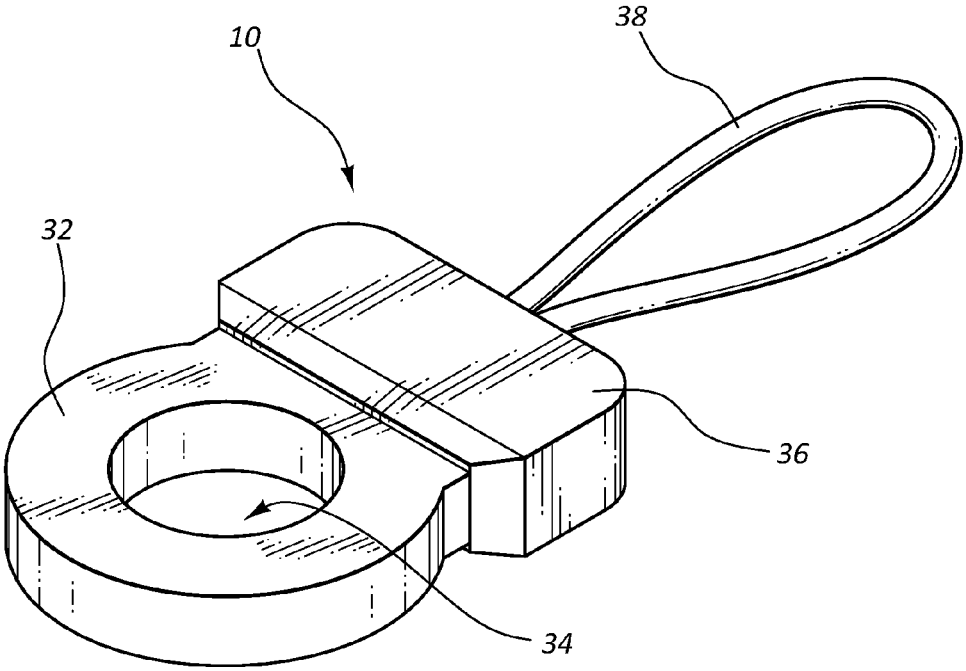
FIG. 4 shows an isometric second view of the zipper pull attachment.

FIG. 3 is a three dimensional view of the zipper pull attachment 10 showing how the support cord 38 is formed into the body of the zipper pull attachment 10. FIG. 4 depicts a isometric view of the zipper pull attachment 10 rotated about 90 degrees from the view shown in FIG. 3. FIGS. 3 and 4 illustrate the main body of the zipper pull attachment 10 with respect to the support cord 38. Because the support cord 38 is molded directly and firmly into the base 36 of the zipper pull attachment 10 the possibility for the device to become dislodged or disassembled is eliminated while wearing the device. As mentioned previously, the body, including the ring 32 and the base 36 of the zipper pull attachment 10, is fabricated from an elastomeric material that is both expandable and flexible. The support cord 38 in contrast to the flexibility of the main doughnut shaped body of the zipper pull attachment 10 is provided with a non-expanding and non-flexing support cord 38. This cord may contain an inner wire 50 that is fabricated with a strong, flexible material, such as plastic. The inner wire 50 allows the support cord 38 to bend yet resists stretch in the support cord 38. This inner wire 50 is provided for strength which is helps secure the support cord 38 when tying the zipper 44 securely in place. A casement of tightly woven synthetic fabric forms an outer fabric casing 52 and is placed over the inner support wire 50.

Figure 5:
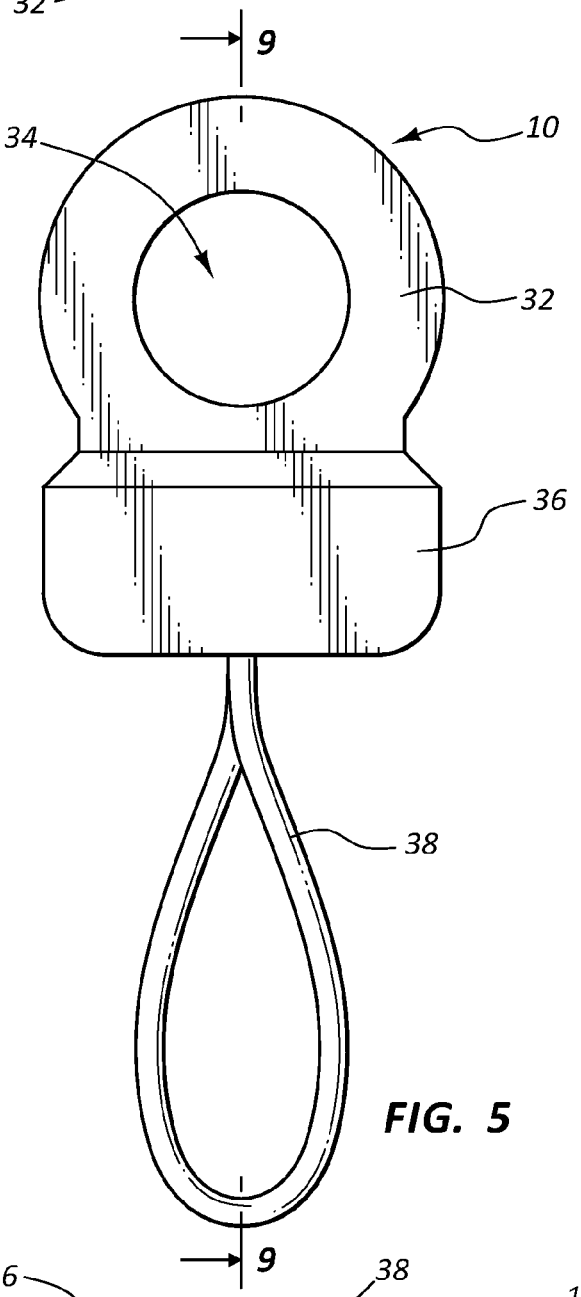
FIG. 5 is a front view of the zipper pull attachment.

FIG. 5 embodies a frontal view of the zipper pull attachment 10 and support cord 38. This view shows the support cord 38, comprising the inner wire 50 and the outer fabric casing 52, further details illustrated in FIG. 9, below. The inner wire 50 is located at the center of the base 36 of the zipper pull attachment 10. The base 36 is shaped to provide a place for the user to grip the zipper pull attachment 10 when assembling or disassembling the device from the jeans 20.

Figure 6:
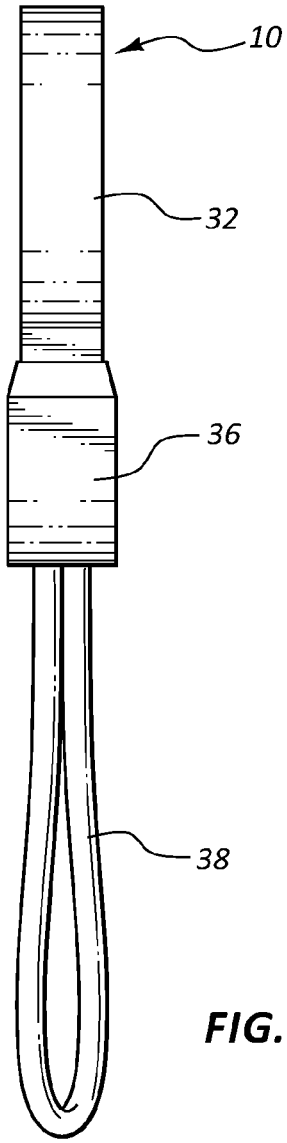
FIG. 6 is a side view of the zipper pull attachment.

FIG. 6 shows a side view of the zipper pull attachment 10. The support cord 38 is shown as being encapsulated in the base 36 of the zipper pull attachment 10. The support cord 38 is located at the center of the base 36 of the zipper pull attachment as may be seen in this figure. The body of the zipper pull attachment 10 includes the ring 32 and base 36 and is made of a flexible material.

Figure 7:
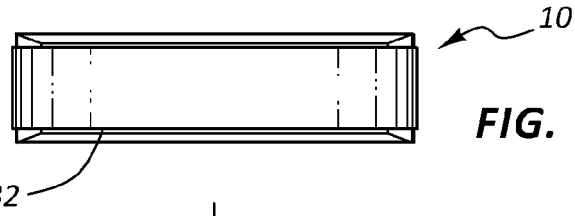
FIG. 7 is a top view of the zipper pull attachment.
Figure 8:
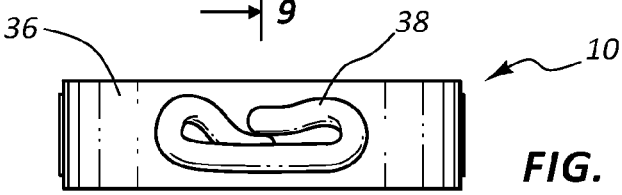
FIG. 8 is a bottom view of the zipper pull attachment.

FIG. 7 depicts the top view and FIG. 8 shows the bottom view of the zipper pull attachment 10. In FIG. 8, the support cord 38 is illustrated, which shows how it loops and connects at the center of the base 36 or ring 32 of the zipper pull attachment 10.

Figure 9:
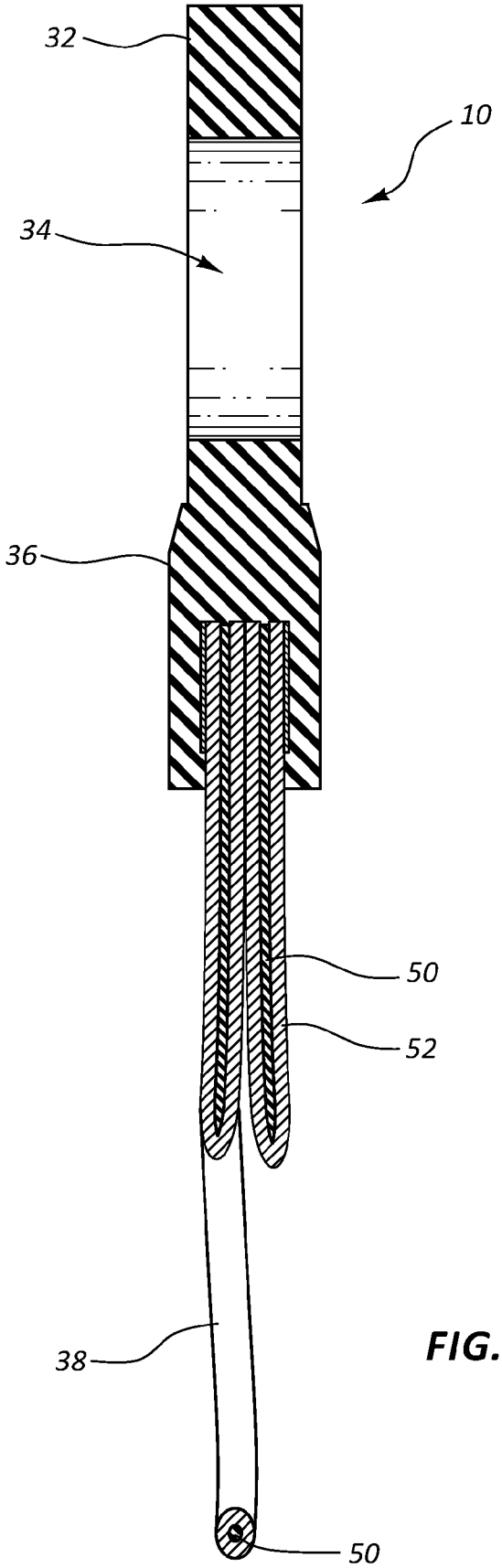
FIG. 9 is a cutaway view of the zipper pull attachment of FIG. 5.

FIG. 9 is a cutaway view taken form FIG. 5 of the zipper pull attachment 10. The section is taken through the center of the body. As may be seen, the support cord 38 made up of the inner wire 50 and the outer fabric casing 52 is shown in this cutaway view. Note that the support cord 38 is at the center of the zipper pull attachment 10 and that the inner wire 50 is at the center of the outer fabric casing 52.

Figure 10:
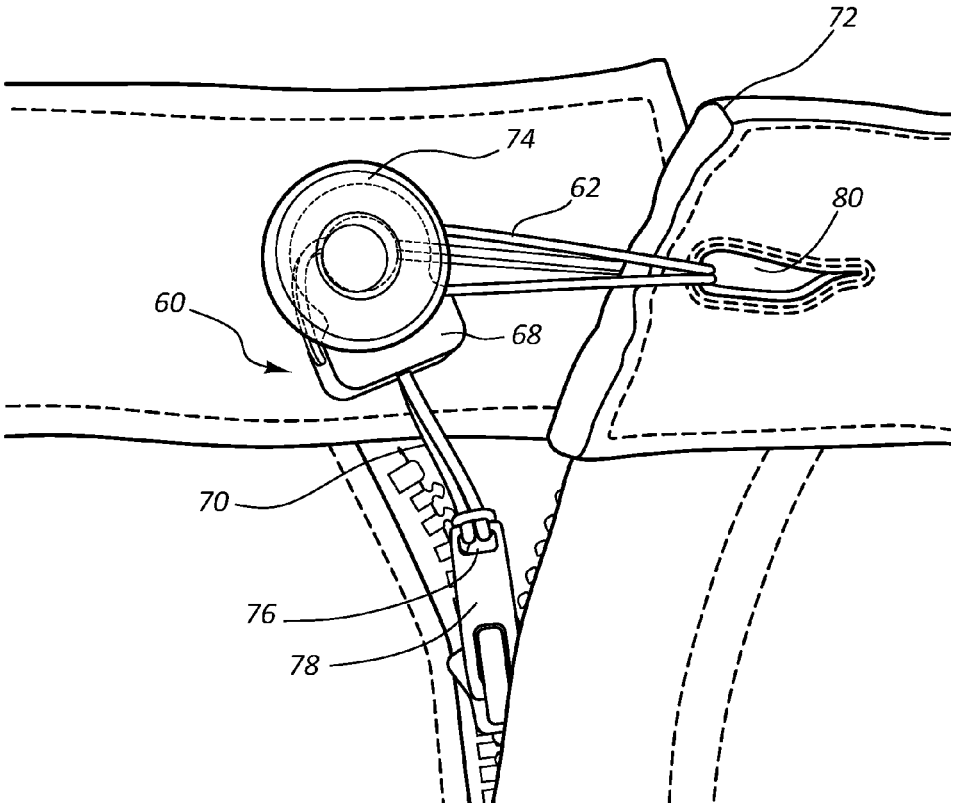
FIG. 10 is an assembly view of a zipper attachment and expansion device, another embodiment of the invention.

FIG. 10 shows a zipper attachment and expansion device 60, which is another embodiment of the invention combining various features: the zipper pull attachment 10 as illustrated in FIGS. 1 through 9 and discussed above combined with a fastener expansion cord 62, discussed below. The fastener expansion cord 62 provides support for an expanded waist area of pants, jeans or other garments. The fastener expansion cord may be made of a stretchy material.

The zipper attachment and expansion device 60 consists of the main elastomeric and flexible body 64, including a ring 66 and base 68, and an embedded support cord 70, which is attached to the flexible body 64 and positioned about 90 degrees from the support cord 70. In FIG. 10, the zipper attachment and expansion device 60 is shown in an assembled position with the device in position on jeans 72. The fastener expansion cord 62 may be disposed in the base and positioned at an offset about 90 degrees from the support cord 70.

One end of the zipper attachment and expansion device 60 is made of a flexible main body 64 which can be fabricated from neoprene or other rubberized material. As an integral part of this flexible main body 64, the ring 66 and base 68 are formed. The ring 66 and base 68 may be fabricated from the same material as the main body 64. As an integral part of the zipper attachment and expansion device, a non-expanding support cord 38 is embedded into the flexible main body 64 at the opposite end of the zipper attachment and expansion device 60.

The support cord 70 is provided in the shape of a loop. The ends of the loop are embedded into the flexible main body 64 and thusly the base 68 of the zipper attachment and expansion device 60 to close the loop. Prior to the zipper attachment and expansion device 60 being attached to a button 74, the support cord 70 may be inserted into an eye 76 of a zipper pull tab 78 and then the other end of the zipper attachment and expansion device 60 may be inserted through the support cord 70 loop, forming a tight half hitch knot around the zipper pull tab 78 at the upper end of the zipper eye 76.

In a pair of jeans, designer jeans, pants, or other garment 72, there is typically a button 74. The button 74 is utilized as a support for one end of the zipper attachment and expansion device 60. Once the knot has been tied through the zipper eye 76, the ring 66 is fastened around the button 74. To do this, the ring 66, which is quite flexible, is stretched over and around the button 74 and then becomes lodged underneath the button 74. Because the ring 66 of the zipper attachment and expansion device 60 is affixed under the button 74, the assembly is attached through the button 74 and through the knotted loop of the support cord 70, forming a somewhat flexible connection of the zipper pull tab 78 to the button 74.

With the zipper pull attachment 10 discussed earlier, the wearer is allowed limited room for body waist expansion. Growth of the wearer's waist is greatly limited with the zipper pull attachment 10 by itself. The zipper is allowed to open, but the jeans remain buttoned at the waist. The zipper attachment and expansion device 60 is designed to allow a great deal of expansion in the waistline while allowing the zipper to be partially lowered. This combination allows a significant enlargement of the waistline of the jeans or other garment. When the jeans become too tight, the user can use the zipper attachment and expansion device 60 to expand the waistline without purchasing new jeans. This combination provides a very unique capability. In the past, only one or the other capability was afforded the wearer. With this device, where both waist expansion and zipper release and capture are provided in one device.

The wearer may choose the amount of girth, or waist expansion desired as well as the preferred amount of zipper release. Various sizes of the zipper attachment and expansion device can be available at a low cost.

The wearer's jeans may look baggy if the zipper were not zipped up as far as possible, especially during the early stages of pregnancy, or in the case of a person who has gained some weight and wants to get further use out of his, or her jeans or other garment. One can see a need for a device that not only provides support at the waist, but also supports the zipper in whatever elevation can be obtained. By holding the zipper in the maximum position of tightness, one can visualize how this would allow the wearer of the pants, jeans, or other garment to be able to maintain a good look with a proper fit that maintains the most flattering effect. This will be achieved by assuring that there is a proper tightness of the pants, or jeans in relation to the shape, or changing shape of the wearer. There are many modern designs of jeans that, when purchased, are purposely tight fitting. Just the smallest amount of weight gain would preclude a person from wearing those now too tight designer jeans. Therefore there is a distinct need for a device that allows both modest, or, especially in the case of a pregnant woman, more robust adjustment of the jeans or garment. In all cases, it is very desirable to be able to maintain a firm fit as much as possible, but allow the flexibility for comfort to be achieved.

The other embodiment, thus, is to provide this desired waist expansion. By selecting the desired amount of zipper opening, the wearer of this zipper pull attachment and fastener expansion device is also able to preselect the amount of girth, or waist expansion desired. The length of both the support cord 70 and the fastener expansion cord 62 may be selected to the desired effect of the wearer.

Once the support cord 70 is connected to the zipper pull tab 78 and the ring 66 is secured to the button 74 as described above, the wearer is now in a position to assemble the fastener expansion cord 62 to the jeans 72. Before buttoning up the jeans 72 into a button hole 80, the wearer threads the fastener expansion cord 62 through the button hole 80 and then brings the loop of the fastener expansion cord 62 around the back side of the button 74, forming an enclosed flexible loop attaching the button hole 80 to the button 74. Thusly, a flexible girth, or waist band, is created for the comfort of the wearer.

Figure 11:
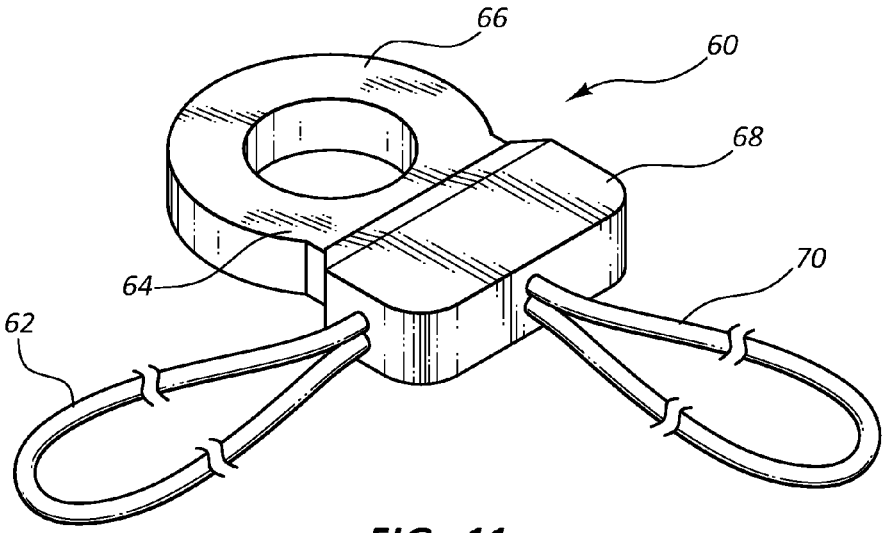
FIG. 11 is an assembly view of the zipper attachment and expansion device shown in a closed position.

FIG. 11 depicts a three-dimensional view of the zipper attachment and expansion device 60. As shown, the support cord 70, which can be made of a non-stretchable material, is formed into the center and at the opposite end of the ring 66 or in the base 68 of the flexible main body 64. The fastener expansion cord 62 in also formed into the flexible main body 64, but positioned at about 90 degrees to the support cord 70. The support cord 70 may be fabricated from a strong, non-stretchable support cord made from a material such as nylon or other material and wrapped around the exterior of this cord is a tightly woven synthetic fabric to give it bulk for ease of handling that is required to attach it to the pants, jeans, or other garment. The fastener expansion cord 62 is fabricated from a flexible material that allows flexibility but at the same time adequate strength to not allow breakage with normal wear.

Figure 12:
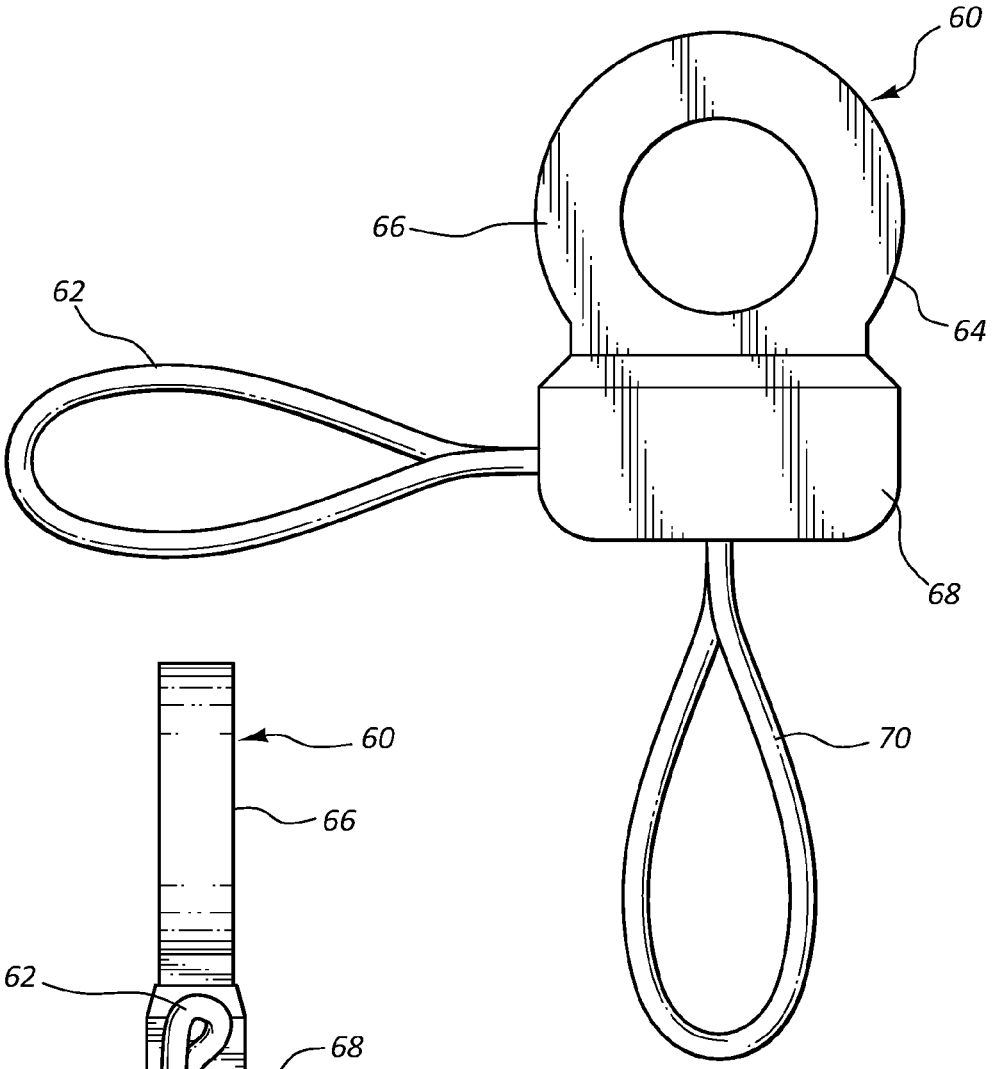
FIG. 12 is a front view of the zipper attachment and expansion device.

FIG. 12 depicts the front view of the zipper attachment and expansion device 60. As appears in this view, the relative spacing of each of the connecting components is depicted. Note that the support cord 70 is placed at the center of the base 68 of the flexible main body 64 and the fastener expansion cord 70 is positioned about 90 degrees with respect to the support cord 62, in the center of the base of the flexible main body 64. The ring 66 is therefore left unrestricted so that it may be fastened, or placed under the button 74 of the jeans 72.

Figure 13:
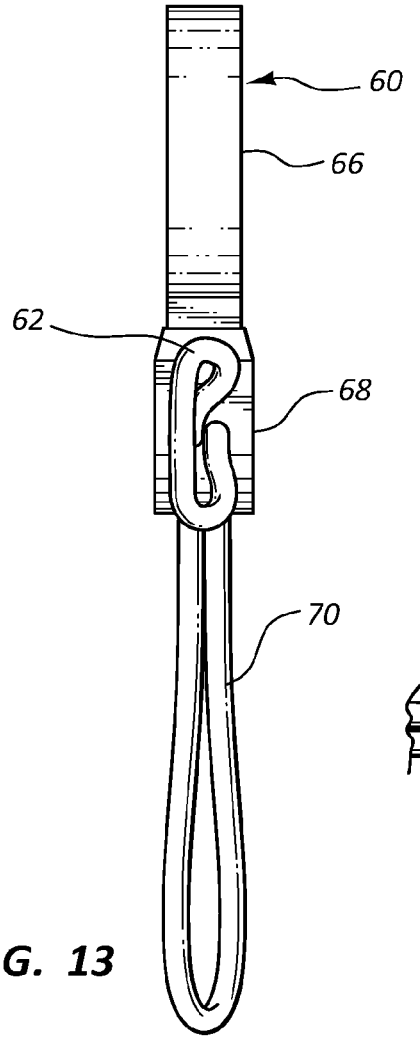
FIG. 13 is a side view of the zipper attachment and expansion device.

FIG. 13 is a side view drawing showing the placement of the fastener expansion cord 62 and the support cord 70. Note again that they are placed about 90 degrees with respect to each other and that they are placed along a centerline of the flexible main body 64.

Figure 14:
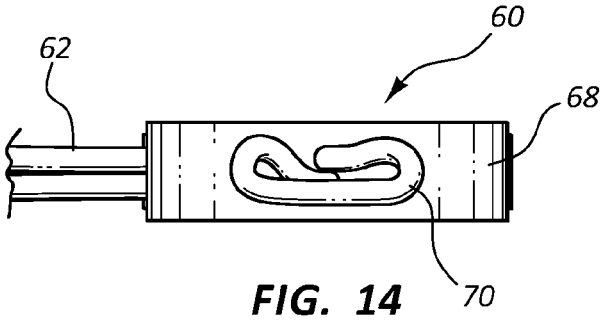
FIG. 14 is a bottom detailed view of the zipper attachment and expansion device.

FIG. 14 is the bottom view of the zipper attachment and expansion device 60. This view illustrates the relative placement of the support cord 70 and the fastener expandable cord 62. Note that the support cord 70 is placed at about the center of the flexible main body 64.

Implementations of the zipper pull attachment 10 and the zipper attachment and expansion device 60 are configured to allow the user to fix the zipper pull and, in another embodiment, expand the waistline of jeans. Accordingly, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A zipper pull attachment, comprising:

a flexible ring having a hole sized to fit snugly around a button on jeans;

a base attached to the ring and configured to be used as a grip;

a support cord attached to the base opposite the ring, the support cord forming a loop and being sized to fit through and attach to an eye of a zipper pull tab; and a fastener expansion cord attached to the base.

2. The zipper pull attachment as claimed in claim 1, wherein the fastener expansion cord is made of a stretchy material.

3. The zipper pull attachment as claimed in claim 1, wherein the fastener expansion cord is disposed in the base and positioned at an offset about 90 degrees from the support cord.

4. A zipper attachment and expansion device, comprising:

a flexible ring having a hole sized to fit snugly around a button on jeans;

a base attached to the ring and configured to be used as a grip;

a support cord attached to the base opposite the ring, the support cord forming a loop and being sized to fit through and attach to an eye of a zipper pull tab; and a fastener expansion cord attached to the base, the fastener expansion cord being positioned at an offset of about 90 degrees from the support cord and forming a loop that is sized to fit from the base through a button hole and back to and around a button.

5. The zipper attachment and expansion device as claimed in claim 4, wherein the hole of the ring is sized to be smaller than the button of the jeans, and the ring configured to expand over the outer circumference of the button.

6. The zipper attachment and expansion device as claimed in claim 4, wherein the base has a thickness greater than the ring.

7. The zipper attachment and expansion device as claimed in claim 4, wherein the support cord includes an inner support wire and an outer fabric casing and the fastener expansion cord is made of a stretchy material.

8. A zipper pull attachment, comprising:

a body configured to be attached to a zipper and a button on jeans, the body being made of a flexible material;

means for attaching the body to the button without being dislodged;

means for attaching the body to a zipper to allow the zipper to move to a closed position but restricts movement beyond a predetermined open position, the zipper being restricted from being substantially opened, the means for attaching the body to a zipper being made of a substantially non-stretchable material; and means for attaching a button hole to a button, the button hole being spaced a distance away from the button when attached to expand the waistline of the jeans.

9. The zipper pull attachment as claimed in claim 8, wherein the means for attaching the button hole is made of a stretchy material.

10. The zipper pull attachment as claimed in claim 8, wherein the means for attaching the button hole is disposed in the body and positioned at an offset about 90 degrees from the means for attaching the body to a button.

* * * * *